United States Patent [19]

Cawley et al.

[11] Patent Number: 4,878,596

[45] Date of Patent: Nov. 7, 1989

[54] WASTE BIN LID

[75] Inventors: Scott A. Cawley; Malcolm E. Vidler, both of Brisbane, Australia

[73] Assignee: Thiess Contractors Pty. Ltd., Queensland, Australia

[21] Appl. No.: 293,963

[22] Filed: Jan. 6, 1989

[30] Foreign Application Priority Data

Aug. 31, 1988 [AU] Australia ..... PJ0154

[51] Int. Cl.[4] ..... B65D 43/20

[52] U.S. Cl. ..... 220/331; 220/1 T; 220/345

[58] Field of Search ..... 220/331, 345, 1 T, 254, 220/255

[56] References Cited

U.S. PATENT DOCUMENTS

| | | | |
|---|---|---|---|
| 1,511,613 | 10/1924 | Joern | 220/1 T |
| 4,152,979 | 5/1979 | Schmidt | 220/1 T X |
| 4,456,141 | 6/1984 | Pamment | 220/1 T |
| 4,545,523 | 10/1985 | Galbreath et al. | 220/1 T X |
| 4,609,117 | 9/1986 | Pamment | 220/331 X |
| 4,653,662 | 3/1987 | Wise et al. | 220/1 T X |

*Primary Examiner*—Steven M. Pollard

*Attorney, Agent, or Firm*—Nixon & Vanderhye

[57] ABSTRACT

A closure means for industrial waste bins of the type which can be inverted and emptied into a waste removal truck. The closure means comprises a hinged frame for connecting to the opening of a bin. The frame includes a fixed lid and a movable lid. The movable lid is displaceable along inclined support guides located on opposite marginal sections of the frame in such a manner that in an open arrangement it overlies the fixed lid and in a closed arrangement it forms a seal between the hinged frame and a marginal upper edge of the fixed lid.

16 Claims, 4 Drawing Sheets

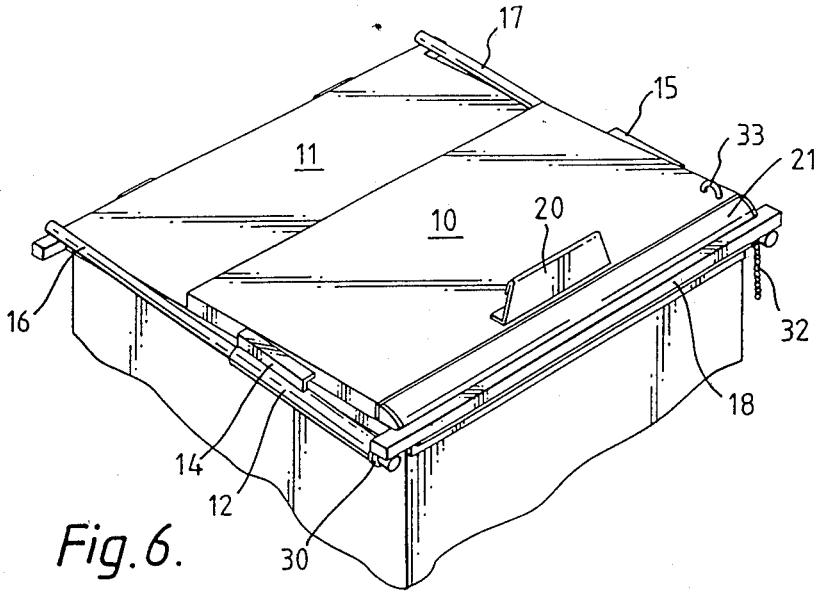
Fig. 6.
Fig. 7.
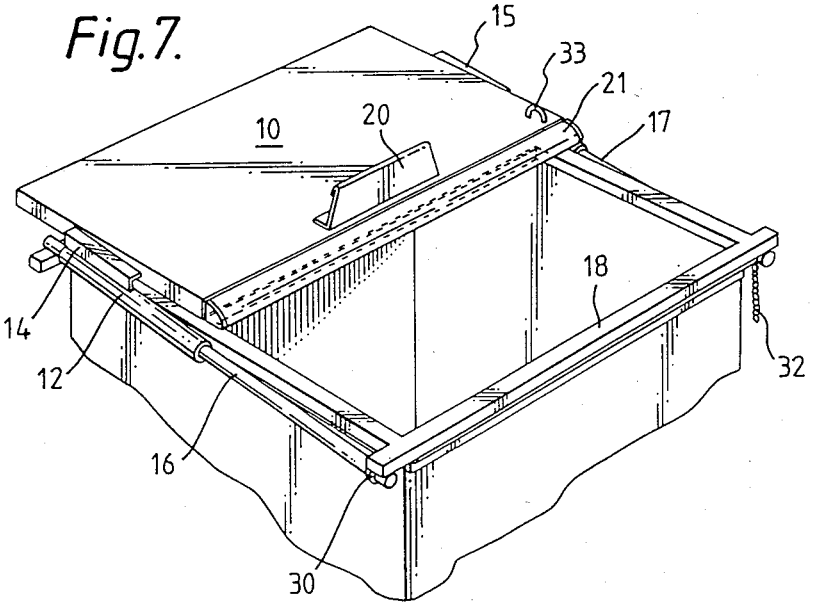

WASTE BIN LID

BACKGROUND OF THE INVENTION

This invention relates to closure means for bins and is particularly concerned with closure means for industrial waste bins of the type which can be inverted and emptied into a waste removal truck.

It is a requirement of many municipalities for industrial waste bins to have a closure means or lid which effectively seals the interior contained waste from the external elements as well as from microorganism transmitting species such as flies. The most common form of lid which meets this requirement is a simple hinged closure which is hingedly connected to a peripheral upper edge of the bin. The closure pivots from a position where it completely overlaps the bin opening, thereby providing the necessary sealing action, through a vertical plane to a fully open position. The problem with such a lid, however, is that the lid must be opened through a relatively high arc and this creates problems when loading the bin with waste. For instance, short people may have difficulty holding onto the handle when the lid passes into its maximum arc, or the lid may prove difficult to open in windy conditions. Additionally, the lid, when being closed, has a tendency to accelerate to its seating position and this can lead to accidents such as fingers or hands being caught in the opening between the upper rim of the bin and the lid. This can be particularly disastrous when the waste bin is constructed from heavy plate iron as it commonly is.

DESCRIPTION OF THE PRIOR ART

These and similar problems have been tackled with varying degrees of success with closure means which slide, fold or pivot in diverse ways, however the arrangements are generally complex or create other problems. Thus U.S. Pat. No. 3,951,302 describes a bin lid comprising two raised portions, one of which is adapted to roll up over the other. When closing, the upper lid rolls back down due to gravity. The problem with this lid is that it is heavy and it is therefore difficult to push the slidable portion up the relatively steep incline of the fixed portion. U.S. Pat. No. 4,152,979 describes a bin lid having a folding lid structure, one portion of which slides to permit depositing of rubbish in the bin. The arrangement is complex and expensive to manufacture. U.S. Pat. No. 4,609,117 describes a waste container with a lid member which is pivoted relative to its rear edge to the upper ends of a pair of arms mounted on opposite ends of the container. The arms are of a length and so mounted that the lid can be moved between a closed position and an open position with the front edge of the lid sliding along the upper edges of the container ends. The lid, however, is difficult to open and the mechanism is subject to dislocation when the bin is inverted for emptying. Additionally, the lid is extremely dangerous upon closing as the closing edges are metal and the shearing of fingers caught therein is a real possibility.

The problems and disadvantages described above have been addressed to a substantial degree by the invention described in Australian Patent Application No. 90,404/82. That invention relates to a pivoting lid and frame for an industrial waste bin, wherein the lid includes a fixed horizontal closure member and a slidable closure member which is adapted to slide directly over or directly under the fixed closure member. The entire framework supporting the lid is pivotal along one edge when the bin is inverted for emptying. However, this arrangement has two principal drawbacks. The first is that edgewise sealing between the slidable closure member and the top of the bin, is not effective. The second is that there is considerable friction between the slidable closure member and its supports, making it relatively difficult to move between the open and closed positions.

OBJECT OF THE INVENTION

It is therefore an object of the present invention to provide an improved closure means for a bin which obviates or at least minimises the aforementioned disadvantages of hinged bin lids.

SUMMARY OF THE INVENTION

According to the invention, there is provided a bin closure means comprising a frame adapted for hinged connection to the opening of a bin such that it forms a seal around the perimeter of the opening and such that it may hinge away from the opening when the bin is inverted during emptying, said frame including a fixed lid and a movable lid, the said movable lid being displaceable along support guides located on two opposite marginal sections of the frame, said support guides being inclined with respect to the plane defining the bin opening so that the movable lid may be displaced between a position overlying and spaced from said fixed lid, and a position where sections of opposed faces of the lids overlap and form a seal therebetween and where the remaining perimeter of the movable lid forms a seal with the frame, thereby closing the bin.

The purpose for the support guides being inclined is to ensure that the movable lid may be displaced relative to the fixed lid without any frictional engagement between the two lids as this would give rise to difficulties in opening and shutting the lid. Additionally, the angling of the support guides enables the movable lid to be brought down hard against the sealing surface to form a good seal when the lid is being closed. The degree of inclination required to achieve this is not great and will not normally be more than a few degrees.

The support guides may be any longitudinally extending members arranged substantially parallel to one another, which permit easy manipulation of the movable lid thereover. To this end, they may be flat, box-section, tubular or rod members, welded or otherwise affixed to opposite sections of the frame. Preferably, the support guides comprise tubular members welded to extend between the corners of opposing sections of the frame.

The movable lid may include co-operating elements formed in opposed edges, which slide or rack over the support guides. Preferably, sleeves are welded to the lid so as to extend below and to the side of opposed edges thereof. The sleeves will be of complimentary shape to the support guides. Thus, in the case of tubular support guides, the sleeves will preferably comprise hollow pipe sections.

It is preferred for the movable lid to be wider than the fixed lid so that more than one half of the bin opening can be exposed when the movable lid is slid to an open position over the fixed lid. To achieve this, the movable lid must extend over the edge of the bin by an amount equal to the difference in the two lid widths. Clearly, the greater the extension past the bin edge, the greater will be the difference between the sizes of the lids until a point is reached where the fixed lid is not required.

However, it is essential to have a fixed lid and it has been found in practice that the fixed lid should be no more than about two-thirds of the width of the movable lid, for maximum convenience and operation.

In order to enable the movable lid to extend past the rear edge of the bin, either the support guides must extend past the edge of the bin or the co-operating elements formed on the opposite margins of the movable lid must be arranged to enable this. The first of these options is least preferred as it means that more space is required for the bin and the protruding support guides with their associated framework, could provide a hazard. In adopting the preferred second option, the co-operating elements formed on the opposite margins of the movable lid are generally required to be shorter than the width of the movable lid and to extend from a position adjacent to the opening edge of the movable lid by a distance approximately commensurate with the width of the fixed lid.

The bin closure means may be constructed to suit any configuration of industrial waste bin. Since such bins are generally hexahedral in shape, the bin opening will normally be rectangular and the bin closure means will be consistently configured. Thus, the framework structure which seats on the upper peripheral edge of bin opening will be rectangular in shape as will the movable and fixed lid elements.

Typical industrial waste bins are manufactured from sheet steel. Accordingly, the possibility of accidents occurring due to wedging hands or fingers between the lid closure means and the bin itself, are real. This is substantially obviated in the present construction however in order to reduce all possibility of injury occurring, it is preferred to include a resiliently flexible sealing strip between the closing edge of the movable lid and the corresponding lip of the bin opening defined by the support framework structure. Such a strip is preferably formed on the movable lid and covers a gap which is purposely left between the bin opening and lid when the lid element is in a fully closed position. Suitable sealing strips are hollow or open profile rubber seals optionally with end caps, solid foamed rubber seals, and the like.

Other attachments such as one or more handles may be formed in the bin closure means by methods commonly known to those skilled in the art. A particularly preferred form of handle is a flat plate extending perpendicular to the opening edge of the movable lid. Since such a flat plate handle cannot be grabbed as if to lift the lid, then the user of the bin will not be prone to any possible strain as a consequence of not appreciating the sliding operation vis-a-vis a lifting operation.

The combination of the bin closure means and the bin itself also constitute an aspect of the invention since it is in this form which the invention is generally marketed. The bin may also have additional features which are commonly part and parcel of existing industrial waste bins, and these also, when combined with the novel closure means, constitute other aspects of the invention. Features worthy of mention include handles for manipulation, accessories for lifting by waste removal vehicles such as lifting fork pockets, wheels for moving, plugged outlets for draining purpose, and so on.

BRIEF DESCRIPTION OF THE DRAWINGS

A preferred embodiment of the invention will now be described with reference to the accompanying drawings, in which:

FIG. 6 is a partial top perspective of a combined industrial waste bin and bin closure means with lid closed;

FIG. 7 is a partial top perspective of a combined industrial waste bin and bin closure means with lid fully open.

DESCRIPTION OF PREFERRED EMBODIMENT

Figure 1:
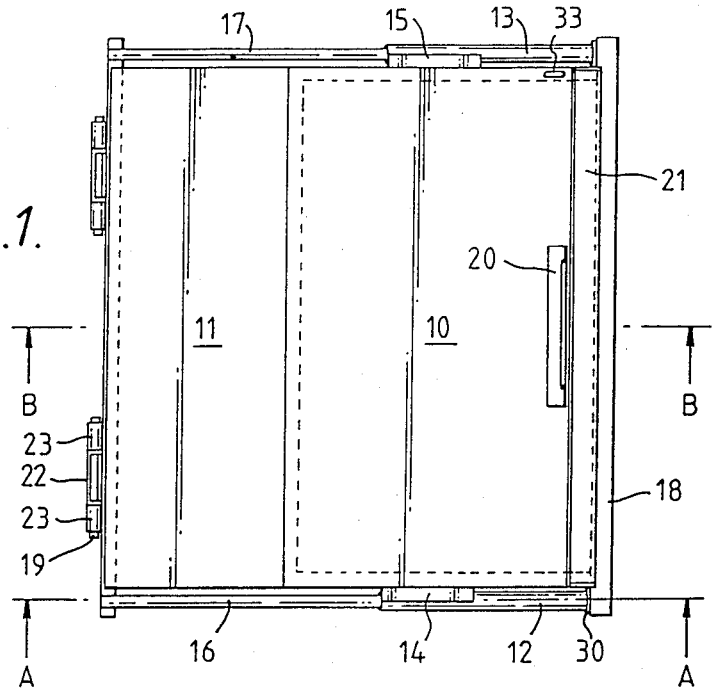
FIG. 1 is a plan view of bin closure means according to the invention.

Referring firstly to FIGS. 1, 2, 6 and 7, there is depicted a bin closure means comprising a movable lid element 10 and a fixed lid element 11. The movable lid element is wider than the fixed lid element and overlaps the fixed lid element by a sufficient amount to form a seal in the region where the lids overlap when the movable lid is in a closed position. The movable lid element includes a pair of sleeves 12, 13 welded to opposed marginal sections by way to intermediary flanges 14, 15. The sleeves are cylindrical tubes supported by cylindrical guides 16, 17 extending exteriorly of the bin in parallel inclined dispositions. The cylindrical guides 16, 17 are co-joined to a rectangular hollow channel framework 18 which sealingly rests on the upper peripheral lipped edge of the bin and is hinged to the bin by huge joint 19. The movable lid element 10 includes a flat handle 20 extending perpendicularly from the lid for sliding the lid between an open and closed position, and a hollow profile rubber sealing strip 21 for sealing the interior of the bin when the movable lid element 10 is in a fully closed position. The rubber sealing strip 21 includes an end cap (not shown) on each end to ensure proper sealing. Also included is a security chain 32 which may be connected by a padlock to loop 33 to prevent unauthorised access to the bin should the waste comprise commercially sensitive material. Such a security chain is also useful in preventing unauthorized dumping in the bin.

Figure 2:
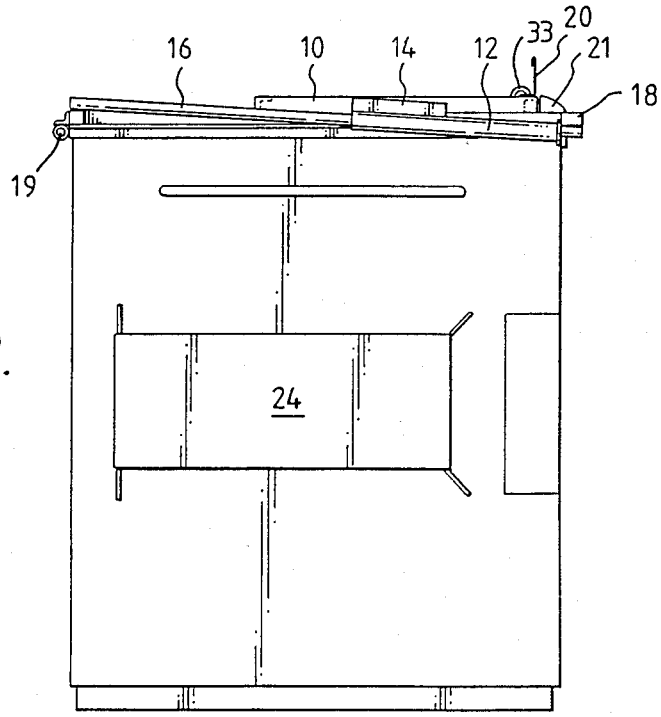
FIG. 2 is a side view of a combined industrial waste bin and bin closure means as illustrated in FIG. 1.
Figure 3:
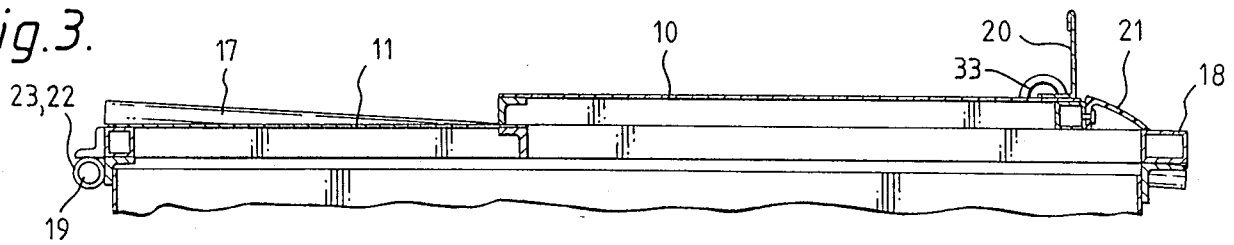
FIG. 3 is a section of the bin closure means through B—B of FIG. 1 with lid closed.
Figure 4:
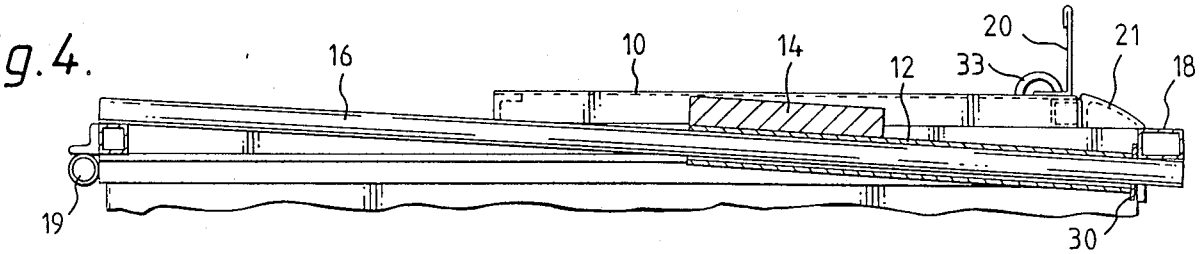
FIG. 4 is a section of the bin closure means through A—A of FIG. 1 with lid closed.
Figure 5:
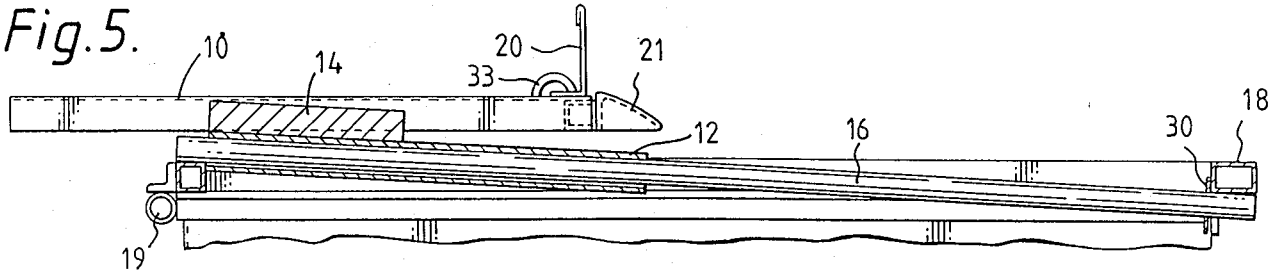
FIG. 5 is a section of the bin closure means through A—A of FIG. 1 with lid open.

FIGS. 3–5 illustrate the bin closure means in more detail. In these figures, like reference numerals to those used in FIGS. 1, 2, 6 and 7 refer to the same features.

As can be seen in FIGS. 3 and 4, when the movable lid element 10 is in a fully retracted position, i.e. closed, the entire bin opening is tightly sealed. The rubber sealing strip 21 overlaps the support framework 18 at the closing edge and its hollow deformable profile avoids crushing of fingers or hands if they happen to be caught when the lid is being closed. The fully closed position of the movable lid element 10 is delimited by the end of the sleeves 12, 13 contacting flanges on the opening end of the framework 18. One of these flanges, viz flange 30, is depicted in FIGS. 4 and 6.

It will be observed, in particular, that the sleeves 12 extend lengthwise by a distance which is approximately two thirds of the width of the movable lid element 10, from the bin opening region. This enables the movable lid to be slid past the bin opening as shown in FIG. 5, thereby enabling a larger access to the interior of the bin than would otherwise be the case.

It will also be observed that the sleeves 12, 13 and their respective support guides 16, 17 are angled to enable the movable lid element 10 to clear the fixed lid element 11 when the movable lid element 10 is being manipulated between open and closed positions. This ensures that there is no frictional engagement between the lid elements and that easy operation is assured. It also ensures that the movable lid element 10 may be firmly seated on the framework 18 in its opposed marginal regions and against the upper surface of the leading edge of the fixed lid element 11 when the lid is closed.

Figure 8:
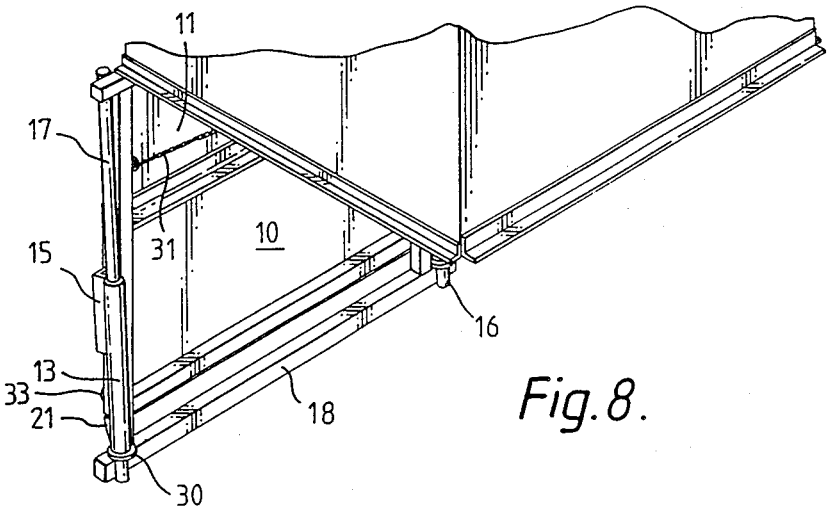
FIG. 8 is a partial perspective view of a combined industrial waste bin and bin closure means which is inverted for emptying.

The hinge joint comprises one hollow pipe element 22 and two adjacent hollow pipe elements 23 with a pin 19 acting as a pivot through the elements. The purpose of the hinge joint 19 is to enable the entire bin closure means to pivot in an arc about the hinge when the bin is inverted for emptying by a waste removal vehicle, as illustrated in FIG. 8. Such an action may be initiated by fork-lifts of a waste removal vehicle being inserted into pockets on either side of the bin (one of which, viz 24, is illustrated in FIG. 2). The bin is then raised and upon rotation of the bin in a clockwise direction (as viewed in FIG. 2) the bin closure means swings away from its seating surface, due to gravity and the waste material falls out into the vehicle. A chain 31 connects to framework 18 to the interior of the bin to prevent the bin closure means swinging open more than the required amount. It also serves to prevent the framework 18 from being rotated through an arc to be back of the bin when the bin is in normal operation.

The provision of such a bin closure means can thus be seen to provide a readily manipulated, safe, vermin and water-proof lid for all manner of bins and thus meeets the objects of the invention.

Whilst the above has been given by way of illustrative example of the invention, many modifications and variations may be made thereto by persons skilled in the art without departing from the broad scope and ambit of the invention as herein set forth in the following claims.

What is claimed is:

1. A bin closure means comprising a frame adapted for hinged connection to the opening of a bin such that it forms a seal around the perimeter of the opening and such that it may hinge away from the opening when the bin is inverted during emptying, said frame including a fixed lid and a movable lid, the said movable lid being displaceable along support guides located on two opposite marginal sections of the frame, said support guides being inclined with respect to the plane defining the bin opening so that the movable lid may be displaced between a position overlying and spaced from said fixed lid, and a position where sections of opposed faces of the lids overlap and form a seal therebetween and where the remaining perimeter of the movable lid forms a seal with the frame, thereby closing the bin.

2. A bin closure means as claimed in claim 1, wherein said movable lid is displaceable in a direction which is at right angles to the hinge axis on the frame on the bin opening.

3. A bin closure means as claimed in claim 1, wherein said support guides comprise longitudinally extending members arranged substantially parallel to one another.

4. A bin closure means as claimed in claim 1, wherein said support guides comprise tubular members extending parallel to one another between the corners of opposing frame sections.

5. A bin closure means as claimed claim 1, wherein said movable lid includes co-operating elements formed in association with two opposing edges which slide over the support guides.

6. A bin closure means as claimed in claim 1, wherein said movable lid includes hollow pipe sections depending from two opposite sides thereof in parallel alignment, which hollow pipe sections are adapted to slide over the support guides located on the adjacent two marginal sections of the frame.

7. A bin closure means as claimed in claim 1, wherein the movable lid has a width dimension which is greater than the width dimension of the fixed lid.

8. A bin closure means as claimed in claim 1, and including a handle on the movable lid.

9. The combination of a waste bin and a bin closure means, said bin closure means comprising a bin closure means comprising a frame adapted for hinged connection to the opening of a bin such that it forms a seal around the perimeter of the opening and such that it may hinge away from the opening when the bin is inverted during emptying, said frame including a fixed lid and a movable lid, the said movable lid being displaceable along support guides located on two opposite marginal sections of the frame, said support guides being inclined with respect to the plane defining the bin opening so that the movable lid may be displaced between a position overlying and spaced from said fixed lid, and a position where sections of opposed faces of the lids overlap and form a seal therebetween and where the remaining perimter of the movable lid forms a seal with the frame, thereby closing the bin, said waste bin being of hexahedral configuration with a rectangular opening and associated lifting fork pockets on exterior opposing sides to enable the bin to be lifted and inverted for emptying purposes.

10. The combination of a waste bin and a bin closure means as defined in claim 9, wherein said movable lid is displaceable in a direction which is at right angles to the hinge axis of the frame on the bin opening.

11. The combination of a waste bin and a bin closure means as defined in claim 9, wherein said support guides comprise longitudinally extending members arranged substantially parallel to one another.

12. The combination of a waste bin and a bin closure means as defined in claim 9, wherein said support guides comprise tubular members extending parallel to one another between the corners of opposing frame sections.

13. The combination of a waste bin and a bin closure means as defined in claim 9, wherein said movable lid includes co-operating elements formed in association with two opposing edges which slide over the support guides.

14. The combination of a waste bin and a bin closure means as defined in claim 9, wherein said movable lid includes hollow pipe sections depending from two opposite sides thereof in parallel alignment, which hollow pipe sections are adapted to slide over the support guides located on the adjacent two marginal sections of the frame.

15. The combination of a waste bin and a bin closure means as defined in claim 9, wherein the movable lid has a width dimension which is greater than the width dimension of the fixed lid.

16. The combination of a waste bin and a bin closure means as defined in claim 9, wherein said bin closure means includes a handle on the movable lid.

* * * * *